US009844959B2

(12) United States Patent
Nakamura

(10) Patent No.: US 9,844,959 B2
(45) **Date of Patent: *Dec. 19, 2017**

(54) RECORDING DEVICE

(71) Applicant: SEIKO EPSON CORPORATION, Tokyo (JP)

(72) Inventor: Tomonori Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/383,590

(22) Filed: Dec. 19, 2016

(65) Prior Publication Data

US 2017/0100947 A1 Apr. 13, 2017

Related U.S. Application Data

(63) Continuation of application No. 14/850,403, filed on Sep. 10, 2015, now Pat. No. 9,555,650, which is a continuation of application No. 14/467,766, filed on Aug. 25, 2014, now Pat. No. 9,156,289.

(30) Foreign Application Priority Data

Sep. 6, 2013 (JP) ..... 2013-184758

(51) Int. Cl.
*B41J 13/00* (2006.01)
*B41J 11/00* (2006.01)

(52) U.S. Cl.
CPC ..... *B41J 13/0009* (2013.01); *B41J 11/0095* (2013.01)

(58) Field of Classification Search
CPC ..... B41J 13/0009; B41J 11/0095
See application file for complete search history.

(56) References Cited

U.S. PATENT DOCUMENTS 5,764,264 A 6/1998 Takanaka
7,370,958 B2 * 5/2008 Lee ..... B41J 3/4078 347/101
7,984,984 B2 7/2011 Kitahara
(Continued)

FOREIGN PATENT DOCUMENTS

JP 05065156 A * 3/1993
JP 08-026588 A 1/1996
(Continued)

*Primary Examiner* — Sharon A Polk
(74) *Attorney, Agent, or Firm* — Global IP Counselors, LLP

(57) ABSTRACT

The recording device includes an adhesive belt extending across a plurality of rotating bodies configured to support and convey a recording medium, a first sensor configured to detect that the recording medium is separated relative to the adhesive belt in a first range, a second sensor configured to detect that the recording medium P is separated relative to the adhesive belt in a second range within the first range, a take-up unit configured to take up the recording medium, and a control unit configured to control the take-up unit so as to take up the recording medium when the first sensor detects that a separation position of the recording medium is within the first range, and control the rotating body to stop movement of the adhesive belt when the second sensor detects that the separation position of the recording medium is within the second range.

5 Claims, 5 Drawing Sheets

(56) References Cited

U.S. PATENT DOCUMENTS

| | | | | |
|---|---|---|---|---|
| 2001/0035978 | A1 | 11/2001 | Sugaya et al. | |
| 2002/0191164 | A1 | 12/2002 | Takamatsu et al. | |
| 2006/0061612 | A1* | 3/2006 | Satoh | B41J 11/007 347/16 |
| 2008/0238977 | A1 | 10/2008 | Nishizaki et al. | |
| 2015/0070431 | A1 | 3/2015 | Nakamura | |

FOREIGN PATENT DOCUMENTS

| | | | |
|---|---|---|---|
| JP | 2002-193509 | A | 7/2002 |
| JP | 2002-362803 | A | 12/2002 |
| JP | 2004-001972 | A | 1/2004 |
| JP | 2007-196625 | A | 8/2007 |
| JP | 2008-105436 | A | 5/2008 |
| JP | 2014-047032 | A | 3/2014 |

* cited by examiner

RECORDING DEVICE

CROSS-REFERENCE TO RELATED APPLICATIONS

This application is a continuation application of U.S. patent application Ser. No. 14/850,403 filed on Sep. 10, 2015, which is a continuation application of U.S. patent application Ser. No. 14/467,766, filed on Aug. 25, 2014, now U.S. Pat. No. 9,156,289. This application claims priority to Japanese Patent Application No. 2013-184758 filed on Sep. 6, 2013. The entire disclosures of U.S. patent application Ser. Nos. 14/850,403 and 14/467,766 and Japanese Patent Application No. 2013-184758 are hereby incorporated herein by reference.

BACKGROUND

Technical Field

The present invention relates to a recording device.

Related Art

From the past, recording devices have been used that support and convey a medium to be recorded using an adhesive belt stretched across a plurality of rotating bodies, with which the medium to be recorded is taken up by a take-up unit. Among these, disclosed are recording devices equipped with sensors for detecting the separation position of the medium to be recorded in relation to the adhesive belt.

For example, disclosed in Japanese Laid-Open Patent Publication No. 2007-196625 is a recording device capable of controlling the separation position of the medium to be recorded according to the difference in degree of tension of a fabric as the medium to be recorded.

Also, disclosed in Japanese Laid-Open Patent Publication No. 2002-193509 is a recording device equipped with a sensor capable of detecting the amount of slack of the medium to be recorded.

However, with the kinds of conventional recording devices noted above, the take-up unit motor has large capacity, and making that a smaller capacity was difficult.

This is because with conventional recording devices, to suppress take-up errors, it was necessary to make the take-up speed of the medium to be recorded by the take-up unit be faster than the conveyance speed of the medium to be recorded by the adhesive belt. The conventional recording devices were not constituted to stop conveyance of the medium to be recorded by the adhesive belt during take-up of the medium to be recorded, and because of that, making the capacity of the take-up unit motor large was unavoidable. In particular, when the roller of the medium to be recorded to be taken up has a small diameter, it is easy for the take-up speed of the medium to be recorded to be slower, so in this kind of case as well, when suppressing take-up errors, it was necessary to use a large capacity motor.

SUMMARY

In light of that, an object of the invention is, with a recording device that supports and conveys a recording medium using an adhesive belt, and takes up the recording medium using a take-up unit, to make a lower capacity take-up unit motor while suppressing take-up errors.

To address the problems noted above, the first recording device according to a first mode of the invention is equipped with an adhesive belt extending across a plurality of rotating bodies configured to support and convey a recording medium, a first sensor configured to detect that the recording medium is separated relative to the adhesive belt in a first range, a second sensor configured to detect that the recording medium is separated relative to the adhesive belt in a second range within the first range, a take-up unit configured to take up the recording medium, and a control unit configured to control the take-up unit so as to take up the recording medium when the first sensor detects that a separation position of the recording medium is be within the first range, and control the rotating bodies to stop movement of the adhesive belt when the second sensor detects that the separation position of the recording medium is within the second range.

Here, "adhesive belt" means a belt coated with an adhesive agent that adheres so as to be separable and holds the recording medium on the surface on which the recording medium is supported.

With this mode, the control unit controls the rotating bodies so as to stop the movement of the adhesive belt when it is detected by the second sensor that the separation position of the recording medium is within the second range. Specifically, during take up of the recording medium, the conveyance of the recording medium by the adhesive belt is stopped. Because of that, it is not necessary to make the take-up speed of the recording medium by the take-up unit faster than the conveyance speed of the recording medium by the adhesive belt to suppress take-up errors. Therefore, it is possible to use a low capacity motor for the take-up unit, and possible to make a smaller capacity motor of the take-up unit while suppressing take-up errors.

The recording device of a second mode of the invention is according to the first mode, wherein the first sensor and the second sensor irradiate light from a direction intersecting a surface of the recording medium, and detect that the recording medium is separated relative to the adhesive belt by using the light reflected from the surface.

With this mode, the first sensor and the second sensor irradiate light from the direction intersecting the surface of the recording medium, and using the light reflected from the surface, detect that the recording medium has separated in relation to the adhesive belt. Because of this, for example, using an optical sensor of a constitution for which a reflective unit is provided on the side facing opposite the irradiating unit, and that receives light which is reflected flight from the reflective unit, light is irradiated from the direction along the surface of the recording medium, and by detecting that the reflected light is blocked by the recording medium, the detection precision is higher than detecting that the recording medium is separated in relation to the adhesive belt.

The recording device of a third mode of the invention is the recording device according to the first mode, equipped with a recording head configured to move back and forth in a direction intersecting a conveyance direction of the recording medium and perform recording, wherein the control unit controls the rotating bodies so that the rotating bodies are intermittently driven according to the back and forth movement, and when, during the recording by the recording head, the second sensor detects that the separation position of the recording medium is within the second range, after the recording has ended according to a movement in one direction among the back and forth movement during recording, controls a movement mechanism of the recording head so as to move the recording head to a home position.

With this mode, during recording by the recording head, when it is detected by the second sensor that separation position of the recording medium is within the second range, the recording head is moved to a home position after recording has ended according to movement in one direction among the back and forth movement during recording. Because of that, it is possible to protect the recording head at the home position while suppressing wasted recording up to the point when a problem occurs with a recorded image due to the recording being ended midway according to movement in one direction among the back and forth movement during recording.

The recording device of a fourth mode of the invention is according to the first mode, equipped with a recording head configure to move back and forth in a direction intersecting a conveyance direction of the recording medium and perform recording, wherein the control unit controls the rotating bodies so that the rotating bodies are intermittently driven according to the back and forth movement, and when the second sensor detects that the separation position of the recording medium is within the second range, controls the rotating bodies so as to stop the movement of the adhesive belt to match a timing when the rotating bodies are not driven according to the intermittent driving.

With the recording device equipped with the recording head that moves back and forth in the direction intersecting the conveyance direction of the recording medium and does recording, during movement of the recording head (during recording), the adhesive belt is stopped.

With this mode, when it is detected by the second sensor that the separation position of the recording medium is within the second range, the rotating bodies are controlled so as to stop the movement of the adhesive belt to match the timing for which the rotating bodies are not driven according to the intermittent driving. Because of this, it is possible to suppress wasted recording up to the point that a problem occurs with the recorded image by the movement distance of the adhesive belt being at a halfway distance because the movement of the adhesive belt is stopped with the timing by which the rotating bodies are driven according to the intermittent driving.

The recording device of a fifth mode of the invention is according to the first mode, equipped with a recording head configured to move back and forth in a direction intersecting a conveyance direction of the recording medium and performing recording, wherein the control unit controls the rotating bodies so that the rotating bodies are intermittently driven according to the back and forth movement, controls the second sensor so as to detect whether or not the separation position of the recording medium is within the second range before the rotating bodies are driven according to intermittent driving, controls the rotating bodies to maintain stopping of the movement of the adhesive belt when the separation position is within the second range, and controls the rotating bodies so that the rotating bodies are driven to match the drive timing of the rotating bodies according to the intermittent driving when the separation position is not within the second range.

According to this mode, before driving of the rotating bodies according to the intermittent driving, it is detected whether or not the separation position of the recording medium is within the second range. Also, if within the second range, stopping of the adhesive belt is maintained, and if not within the second range, the rotating bodies are driven to match the drive timing of the rotating bodies according to the intermittent driving. Because of this, in a state with the adhesive belt movement stopped, the separation position of the recording medium can be detected as being within the second range or not, and it is possible to suppress the occurrence of a problem with the recording operation such as stopping of movement of the adhesive belt at a halfway position.

The recording device of a sixth mode of the invention performs taking up of the recording medium and stopping of movement of an adhesive belt according to a separation position of the recording medium relative to the adhesive belt that extends across a plurality of rotating bodies configured to support and convey the recording medium.

With this mode, taking up of the recording medium and stopping of movement of the adhesive belt are performed according to the separation position of the recording medium in relation to the adhesive belt. Because of this, it is possible to use a constitution that does not require the take-up speed of the recording medium by the take-up unit to be faster than the conveyance speed of the recording medium by the adhesive belt to suppress take-up errors. Therefore, it is possible to use a low capacity motor for the take-up unit, so it is possible to make the motor for the take-up unit smaller capacity while suppressing take-up errors.

BRIEF DESCRIPTION OF THE DRAWINGS

Referring now to the attached drawings which form a part of this original disclosure.

DETAILED DESCRIPTION OF EXEMPLARY EMBODIMENTS

Following, we will give a detailed description of the recording device of an embodiment of the present invention while referring to the attached drawings.

Figure 1:
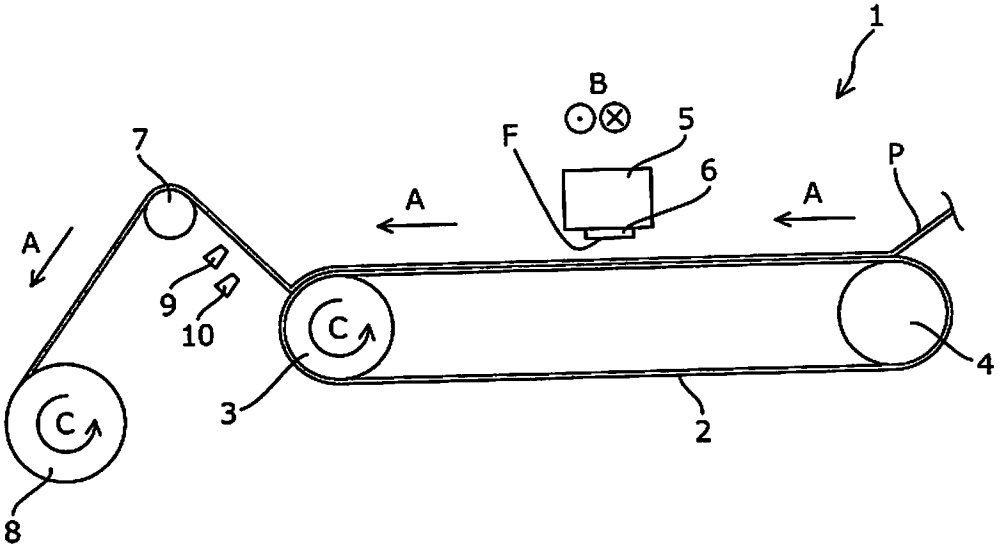
FIG. 1 is a schematic side view showing the recording device of an embodiment of the present invention.

FIG. 1 is a schematic side view showing a recording device 1 of an embodiment of the present invention.

The recording device 1 of this embodiment is equipped with an adhesive belt 2 that is stretched across a drive roller 3 and a driven roller 4 that rotate in a rotation direction C, and supports a recording medium P and conveys it in a conveyance direction A. To express this another way, the adhesive belt 2 is stretched across a plurality of rotating bodies, and is a conveyor belt that supports and conveys the recording medium P. The recording device 1 of this embodiment is equipped with the two rollers including the drive roller 3 and the driven roller 4 as the plurality of rotating bodies, but it is also possible to equip it with three or more rollers, and to have a plurality of those be drive rollers.

Here, "adhesive belt" means a belt coated with an adhesive agent holding the recording medium adhered so as to be able to be separable on the surface that supports the recording medium.

Also, a recording head 6 is equipped in the path for conveying of the recording medium P by the adhesive belt 2. The recording device 1 discharges ink on the recording medium from ink discharge surface F of the recording head 6 while moving the recording head 6 back and forth in a direction B intersecting the conveyance direction A via a carriage 5, and forms a desired image.

The recording device 1 of this embodiment is equipped with the recording head 6 that records while moving back and forth, but it is also possible to have the recording device equipped with a so-called line head on which are provided a plurality of nozzles that discharge ink in the direction intersecting the conveyance direction A.

Here, a "line head" is a recording head for which a nozzle area formed in the intersecting direction that intersects the conveyance direction A of the recording medium P is provided so that the entire intersecting direction of the recording medium P can be covered, used with a recording device that forms images by having one of the recording head or the recording medium fixed and having the other one move. It is also acceptable to have a nozzle area in the intersecting direction of the line head for which the entire intersecting direction of all the recording medium P that the recording device handles cannot be covered.

With the recording device 1 of this embodiment, as described later, the recording medium P is separated from the adhesive belt 2 within a designated range, and is taken up by a take-up unit 8 via a driven roller 7 fixed at a designated position. When the take-up unit 8 takes up the recording medium P, the recording medium P is rotated in the rotation direction C.

A first sensor 9 and a second sensor 10 are provided between the position at which the recording medium P is separated from the adhesive belt 2 and the position at which the driven roller 7 is provided, which is the conveyance path of the recording medium P.

Here, the first sensor 9 and the second sensor 10 are optical sensors that irradiate light from the direction intersecting the surface of the recording medium P, and detect that the recording medium P is separated in relation to the adhesive belt 2 by the light reflected from the surface of the recording medium P.

Because of this, for example, using an optical sensor constituted with a reflecting unit provided at the side facing opposite the irradiating unit, which receives the reflected light from the reflecting unit, by irradiating light from the direction along the surface of the recording medium P and detecting that the reflected light is blocked by the recording medium P, the detection precision is higher than the conventional method of detecting that the recording medium P has separated in relation to the adhesive belt 2. This is because with this kind of conventional method, since the length (thickness) in the direction intersecting the surface of the recording medium P is short, there are cases when detection errors occur by there being a skew between the detection timing by the optical sensor and the timing at which the reflected light is blocked by the recording medium P.

Next, we will describe the electrical configuration for the recording device 1 of this embodiment.

Figure 2:
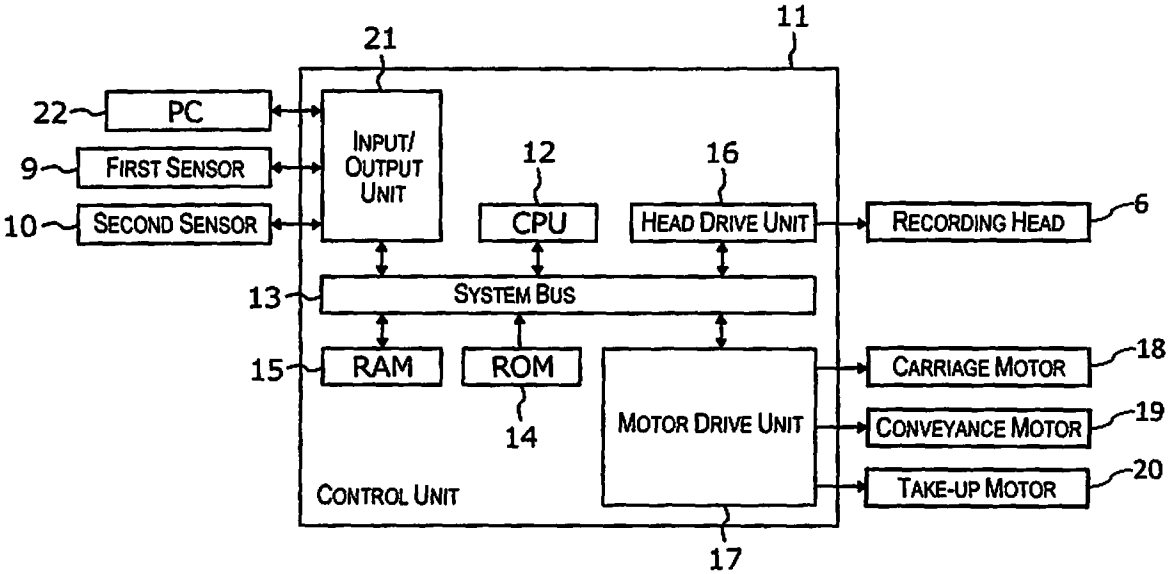
FIG. 2 is a block diagram of the recording device of an embodiment of the present invention.

FIG. 2 is a block diagram of the recording device 1 of this embodiment.

A CPU 12 that performs control of the overall recording device 1 is provided in a control unit 11. The CPU 12 is connected via a system bus 13 to a ROM 14 in which is stored the various control programs and maintenance sequences and the like executed by the CPU 12 and a RAM 15 in which data can be temporarily stored.

Also, the CPU 12 is connected via the system bus 13 to a head drive unit 16 for driving the recording head 6.

Also, the CPU 12 is connected via the system bus 13 to a motor drive unit 17 for driving a carriage motor 18 for driving a carriage 5, a conveyance motor 19 which is the drive source of the drive roller 3 as the moving mechanism of the adhesive belt 2 that supports and conveys the recording medium P, and a take-up motor 20 that is the drive source of the take-up unit 8.

Furthermore, the CPU 12 is connected via the system bus 13 to an input/output unit 21, and the input/output unit 21 is connected to the first sensor 9, the second sensor 10, and a PC 22 which is an external device for inputting recording data and the like to the recording device 1.

Next, we will give a more detailed description using the key parts enlarged views of the recording device 1 of this embodiment.

Figure 3:
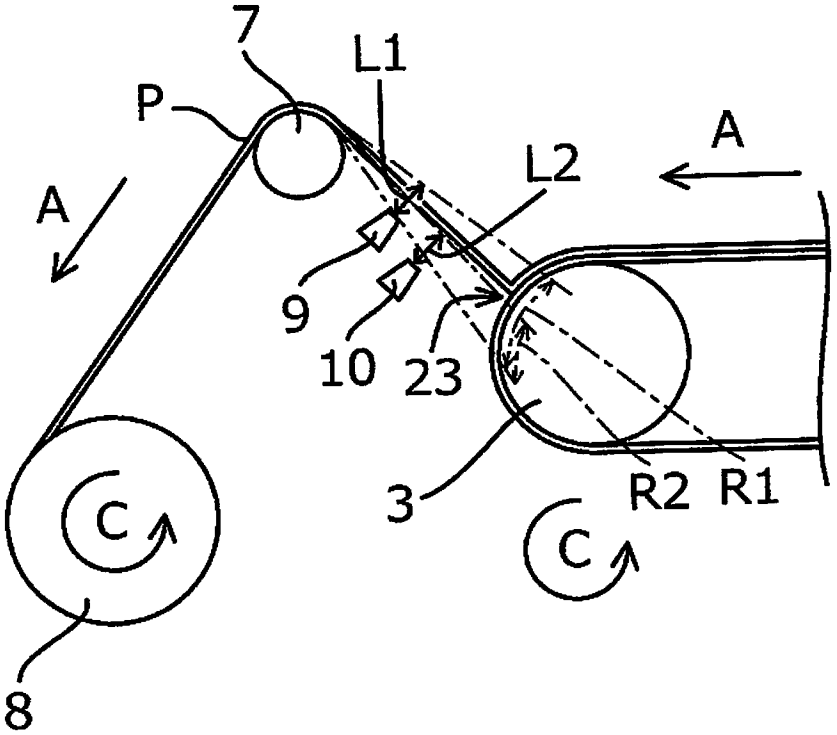
FIG. 3 is a key parts enlarged view of the recording device of an embodiment of the present invention.
Figure 4:
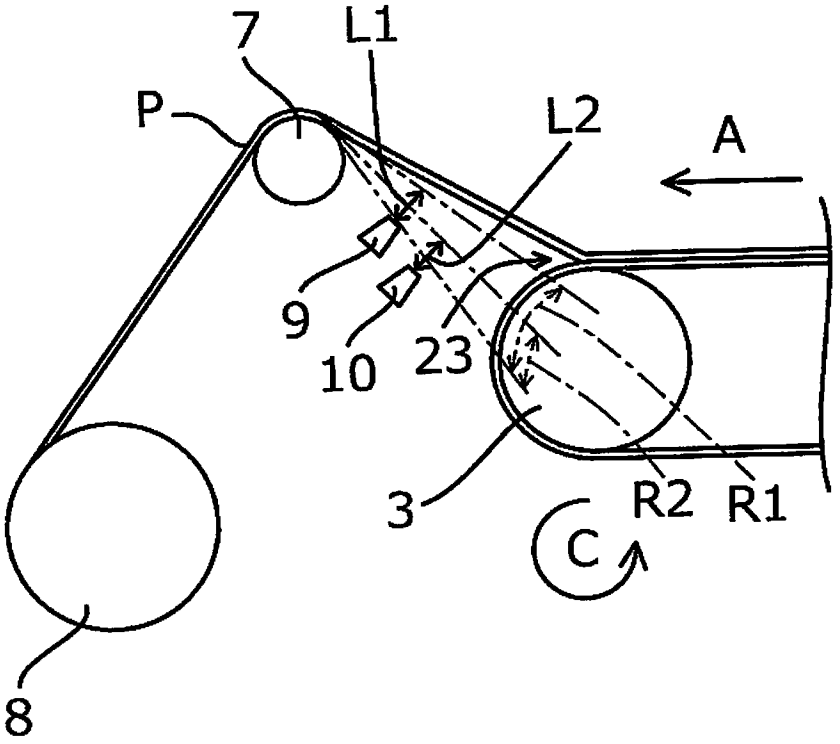
FIG. 4 is a key parts enlarged view of the recording device of an embodiment of the present invention.
Figure 5:
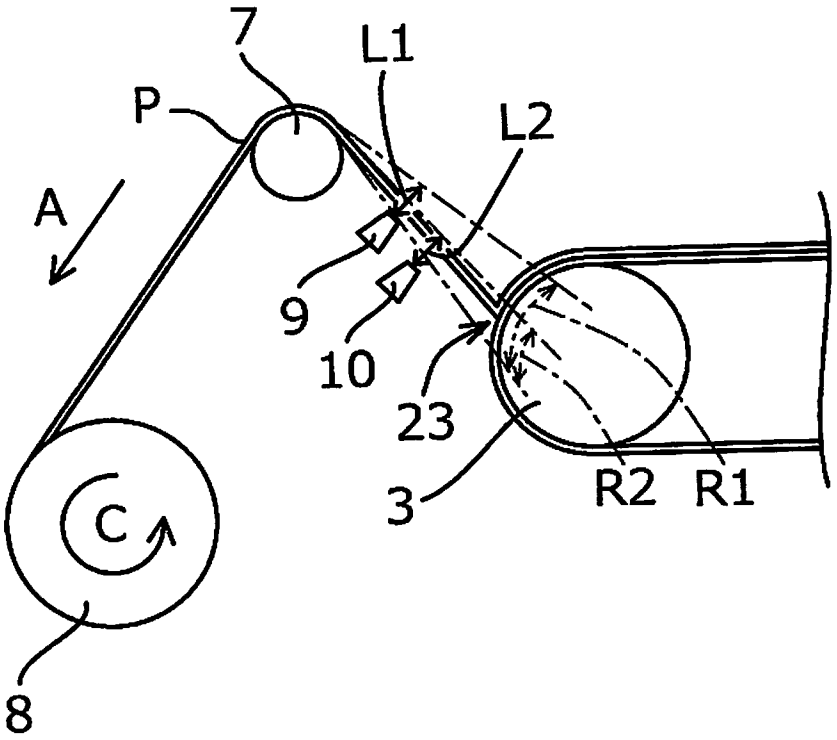
FIG. 5 is a key parts enlarged view of the recording device of an embodiment of the present invention.

FIG. 3 through FIG. 5 are key parts enlarged views of the recording device 1 of this embodiment.

In FIG. 3 through FIG. 5, the first sensor 9 is able to detect whether or not a separation position 23 of the recording medium P in relation to the adhesive belt 2 is within a first range R1 by detecting whether or not the recording medium P is in the detection range of a length L1 (whether or not reflected light from the surface of the recording medium P is made incident). Specifically, the first sensor 9 detects that the recording medium P is separated in relation to the adhesive belt 2 in the first range R1.

Also, the second sensor 10 is able to detect whether or not the separation position 23 of the recording medium P in relation to the adhesive belt 2 is within the second range R2 that is within the first range R1 by detecting whether the recording medium P exists in the detection range of a length L2 (whether or not reflected light from the surface of the recording medium P is made incident). Specifically, the second sensor 10 detects that the recording medium P is separated in relation to the adhesive belt 2 in the second range R2 within the first range R1.

Here, FIG. 3 shows the state when the separation position 23 of the recording medium P is within the first range R1 but outside of the second range R2. Also, FIG. 4 shows the state when the separation position 23 of the recording medium P is outside the first range 1 (specifically, outside the second range R2). Also, FIG. 5 shows the state when the separation position 23 of the recording medium P is within the first range R1 and within the second range R2.

Specifically, with the state in FIG. 3 as a reference, if the state of the take-up speed of the recording medium P by the take-up unit 8 being faster than the conveyance speed of the recording medium P by the adhesive belt 2 continues, or if the movement of the adhesive belt 2 stops and the take-up of the recording medium P by the take-up unit 8 continues, the state in FIG. 4 results. Also, if the state of the take-up speed of the recording medium P by the take-up unit 8 being slower than the conveyance speed of the recording medium P by the adhesive belt 2 continues, or the state of the take-up of the recording medium P by the take-up unit 8 is stopped and the movement of the adhesive belt 2 continues, the state in FIG. 5 results.

Also, the control unit 11 shown in FIG. 2 controls the take-up unit 8 to take up the recording medium P when it is detected by the first sensor 9 that the separation position 23 of the recording medium P is within the first range R1. FIG. 3 and FIG. 5 show the state of the separation position 23 of the recording medium P being within the first range R1, and the take-up unit 8 taking up the recording medium P in the rotation direction C by control of the control unit 11.

Also, the control unit 11 controls the drive roller 3 so as to stop the movement of the adhesive belt 2 when it is detected by the second sensor 10 that the separation position 23 of the recording medium P is within the second range R2.

FIG. 5 shows the state when the separation position 23 of the recording medium P is within the second range R2, and shows the state when the drive roller 3 rotation is stopped so as to stop movement of the adhesive belt 2 by control of the control unit 11.

Also, FIG. 4 shows the state when the separation position 23 of the recording medium P is outside the first range R1, and shows the state when by the control of the control unit 11, the take-up operation of the recording medium by the take-up unit 8 is stopped, and the drive roller 3 is intermittently driven in the rotation direction C following the intermittent recording by the recording head 6.

By having this kind of constitution, the recording device 1 of this embodiment suppresses take-up error, so it is not necessary to make the take-up speed of the recording medium P by the take-up unit 8 be faster than the conveyance speed of the recording medium P by the adhesive belt 2. This is because as described above, when in the kind of state shown in FIG. 5, the movement of the adhesive belt 2 stops. Therefore, it is possible to use a low capacity motor for the take-up unit 8, and to make the capacity smaller for the motor of the take-up unit 8 while suppressing take-up error.

As described above, the recording device 1 of this embodiment is equipped with the recording head 6 that moves back and forth in the direction B intersecting the conveyance direction A of the recording medium P and does recording.

Here, the control unit 11 controls the drive roller 3 so that the drive roller 3 is driven intermittently according to the back and forth movement. Also, during recording by the recording head 6, when it is detected by the second sensor 10 that the separation position 23 of the recording medium P is within the second range R2, after recording has ended according to movement in one direction among the back and forth movement during recording, the control unit 11 controls the moving mechanism of the recording head 6 constituted from a carriage motor 18 or the like so as to move the recording head 6 to the home position.

By this kind of control by the control unit 11, by ending the recording midway according to the movement in one direction among the back and forth movement during recording, the recording head 6 is protected at the home position while suppressing waste of the recording up to that point when there is occurrence of a problem with the recorded image.

As noted above, the recording device 1 of this embodiment is equipped with the recording head 6 which moves back and forth in the direction B intersecting the conveyance direction A of the recording medium P and does recording. With the recording device 1 equipped with the recording head 6 that moves back and forth in the direction B intersecting the conveyance direction A of the recording medium P and does recording, during movement of the recording head 6 (during recording), it is necessary to stop the adhesive belt 2. In light of that, the control unit 11 controls the drive roller 3 so that the drive roller 3 is intermittently driven according to the back and forth movement.

Also, when it is detected by the second sensor 10 that the separation position 23 of the recording medium P is within the second range R2, the control unit 11 controls the drive roller 3 to stop the movement of the adhesive belt 2 to match the timing for which the drive roller 3 is not driven according to the intermittent driving.

Here, with this kind of control by the control unit 11, it is possible to suppress the recording up to that point being wasted when a problem with the recorded image occurs by the movement of the adhesive belt 2 being stopped at the timing at which the drive roller 3 is driven according to the intermittent driving and the movement distance of the adhesive belt 2 being at a halfway distance.

As noted above, the recording device 1 of this embodiment is equipped with the recording head 6 that moves back and forth in the direction B intersecting the conveyance direction A of the recording medium P and does recording.

Here, the control unit 11 controls the drive roller 3 so that the drive roller 3 is intermittently driven according to the back and forth movement. Also, before driving the drive roller 3 according to the intermittent driving, the second sensor 10 is controlled to detect whether or not the separation position 23 of the recording medium P is within the second range R2. Also, if it is within the second range R2, it controls the drive roller 3 so as to maintain stopping of the movement of the adhesive belt 2. Also, if it is not within the second range R2, it controls the drive roller 3 so that the drive roller 3 is driven to match the drive timing of the drive roller 3 according to the intermittent driving.

With this kind of control by the control unit 11, in a state with the movement of the adhesive belt 2 stopped, it is detected whether or not the separation position 23 of the recording medium P is within the second range R2. Also, there is suppression of the occurrence of problems with the recording operation due to movement of the adhesive belt 2 stopping at a halfway position or the like.

To summarize the description noted above, the recording device 1 of this embodiment performs take-up of the recording medium P and stopping of the movement of the adhesive belt 2 according to the separation position 23 of the recording medium P in relation to the adhesive belt 2 that is stretched across the plurality of rotating bodies and supports and conveys the recording medium P.

Because of this, it is possible to have a constitution that does not require making the take-up speed of the recording medium P by the take-up unit 8 faster than the conveyance speed of the recording medium P by the adhesive belt 2 in order to suppress take-up error. Therefore, since it is possible to use a low capacity motor for the take-up unit 8, it is possible to have a lower capacity motor for the take-up unit 8 while suppressing take-up errors.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device, comprising:

an adhesive belt extending across a plurality of rotating bodies that are arranged apart from each other in a first direction, the adhesive belt being configured to support and convey a rolled medium;

a take-up unit configured to take up the rolled medium;

a first sensor configured to control the take-up unit to take up the rolled medium;

a second sensor configured to detect that the rolled medium is overcarried by the adhesive belt; and a control unit configured to control the rotating bodies to start taking up the rolled medium according to output of the first sensor, and configured to stop driving the adhesive belt in response to determining that the rolled medium is overcarried according to output of the second sensor.

2. The recording device according to claim 1, wherein the first sensor and the second sensor irradiate light from a direction intersecting a surface of the rolled medium, and detect that the rolled medium is separated relative to the adhesive belt by using the light reflected from the surface.

3. The recording device according to claim 1, further comprising a recording head configured to move back and forth in a direction intersecting a conveyance direction of the rolled medium and perform recording, wherein the control unit controls the rotating bodies so that the rotating bodies are intermittently driven according to back and forth movement of the recording head in the direction intersecting the conveyance direction, and when, during the recording by the recording head, the second sensor detects that a separation position of the rolled medium is within a second range, after the recording has ended according to a movement in one direction among the back and forth movement during the recording, the control unit controls a movement mechanism of the recording head so as to move the recording head to a home position.

4. The recording device according to claim 1, further comprising a recording head configured to move back and forth in a direction intersecting a conveyance direction of the rolled medium and perform recording, wherein the control unit controls the rotating bodies so that the rotating bodies are intermittently driven according to back and forth movement of the recording head in the direction intersecting the conveyance direction, and when the second sensor detects that a separation position of the rolled medium is within a second range, the control unit controls the rotating bodies so as to stop the movement of the adhesive belt to match a timing when the rotating bodies are not driven according to intermittent driving of the rotating bodies.

5. The recording device according to claim 1, further comprising a recording head configured to move back and forth in a direction intersecting a conveyance direction of the rolled medium and perform recording, wherein the control unit controls the rotating bodies so that the rotating bodies are intermittently driven according to back and forth movement of the recording head in the direction intersecting the conveyance direction, controls the second sensor so as to detect whether or not a separation position of the rolled medium is within a second range before the rotating bodies are driven according to intermittent driving of the rotating bodies, controls the rotating bodies to maintain stopping of the movement of the adhesive belt when the separation position is within the second range, and controls the rotating bodies so that the rotating bodies are driven to match the drive timing of the rotating bodies according to the intermittent driving when the separation position is not within the second range.

* * * * *